US008790099B2

(12) United States Patent
Qu et al.

(10) Patent No.: US 8,790,099 B2
(45) Date of Patent: Jul. 29, 2014

(54) ROTARY COMPRESSOR WITH SYNCHRONOUS TURNING BETWEEN CYLINDER BLOCK AND ROTOR

(75) Inventors: Zongchang Qu, Shaanxi (CN); Xiaodong Hou, Jiangsu (CN)

(73) Assignee: Dafeng Fengtai Fluid Machinery Technology Co., Ltd., Jiangsu (CN)

( * ) Notice: Subject to any disclaimer, the term of this patent is extended or adjusted under 35 U.S.C. 154(b) by 760 days.

(21) Appl. No.: 12/865,112

(22) PCT Filed: Jan. 29, 2008

(86) PCT No.: PCT/CN2008/070206

§ 371 (c)(1),
(2), (4) Date: Jul. 28, 2010

(87) PCT Pub. No.: WO2009/094862

PCT Pub. Date: Aug. 6, 2009

(65) Prior Publication Data

US 2010/0310400 A1 Dec. 9, 2010

(51) Int. Cl.
*F04C 2/332* (2006.01)

(52) U.S. Cl.
USPC ..... 418/173; 418/172

(58) Field of Classification Search
USPC ..... 418/173, 160, 161, 164, 172, 174
See application file for complete search history.

(56) References Cited

U.S. PATENT DOCUMENTS

| | | | | | |
|---|---|---|---|---|---|
| 1,444,440 | A | * | 2/1923 | Wilson | 418/172 |
| 1,496,704 | A | * | 6/1924 | Caminez | 418/173 |
| 1,719,954 | A | * | 7/1929 | Wilson | 418/173 |
| 1,806,206 | A | * | 5/1931 | Lees | 418/173 |
| 1,828,245 | A | * | 10/1931 | Davidson | 418/173 |
| 2,498,715 | A | * | 2/1950 | Seastrom | 418/174 |
| 4,568,257 | A | * | 2/1986 | Moore | 418/173 |

FOREIGN PATENT DOCUMENTS

| | | | | | |
|---|---|---|---|---|---|
| CN | 1264792 | A | * | 8/2000 | F04C 2/46 |
| CN | 1276479 | A | * | 12/2000 | F04C 2/44 |

(Continued)

OTHER PUBLICATIONS

International Search Report of PCT/CN2008/070206, mailed Nov. 6, 2008.

*Primary Examiner* — Mary A Davis
(74) *Attorney, Agent, or Firm* — Global IP Services; Tianhua Gu

(57) ABSTRACT

A rotary compressor includes a casing (1), a cylinder block (2), a rotor (3), a sliding plate (4), and a discharge valve (7). A suction port (6) and a discharge port (8) are provided on the casing (1). A rotating center axis of the cylinder block (2) deflects from a rotating center axis of the rotor (3), so that an outer circumference surface of the rotor (3) is inscribed with an inner circumference surface of the cylinder block (2). A head portion of the sliding plate (4) is embedded in a cylindrical body of the cylinder block (2), and a main body of the sliding plate (4) extends into a sliding plate slot of the rotor (3). The discharge valve (7) is provided on the outer circumference of the rotor (3) in front of a rotating direction of the sliding plate (4). A cylinder block inlet (12) is provided on the cylinder block (2) in rear of the rotating direction of the sliding plate (4). The sliding plate (4) and the inscribed point separate a crescent working volume between the inner circumference surface of the cylinder block (2) and the outer circumference surface of the rotor (3) into a suction chamber and a discharge chamber.

20 Claims, 6 Drawing Sheets

(56) References Cited

FOREIGN PATENT DOCUMENTS

| | | | | | |
|---|---|---|---|---|---|
| CN | 2438850 | Y | * | 7/2001 | ..... F04C 18/344 |
| CN | 2528971 | Y | * | 1/2003 | ..... F04C 21/00 |
| CN | 1141496 | C | * | 3/2004 | ..... F04C 18/344 |
| CN | 1323243 | C | * | 6/2007 | ..... F04C 29/00 |
| CN | 200971862 | Y | * | 11/2007 | ..... F04C 18/344 |

* cited by examiner

ROTARY COMPRESSOR WITH SYNCHRONOUS TURNING BETWEEN CYLINDER BLOCK AND ROTOR

CROSS REFERENCE TO RELATED PATENT APPLICATION

The present application is the US national stage of PCT/CN2008/070206 filed on Jan. 29, 2008, which application is incorporated herein by reference.

BACKGROUND OF THE INVENTION

1. Field of Invention

The present invention relates to an air compressor, a liquid transfer pump, and a refrigeration and air-conditioning compressor, and more particularly to a compression device with a rotor and a cylinder block rotating synchronously.

2. Related Art

The current compressor in use includes a reciprocating compressor, a rolling rotor compressor, a vane compressor, a scroll compressor, and a screw compressor. Due to the inertia force that is hard to be balanced, the reciprocating compressor has the defects of high vibration, low rotation speed, and large volume. Further, a high relative movement speed exists between the moving piston and the stationary cylinder block of the reciprocating compressor, so the friction and abrasion are severe. Moreover, the suction and discharge valves and the piston ring, etc., of the reciprocating compressor are wearing parts, which is also the fatal defect of the compressor and causes poor reliability and low efficiency of the running machine. The cylinder block of the rolling rotor compressor is stationary, and when the rotor moves, an engagement point of the rotor on an inner surface of the cylinder block moves at a high relative speed and the rotor also moves at a high speed relative to the sliding plate, so the friction and abrasion are severe. The cylinder block of the vane compressor is also stationary, and when the rotor rotates, the vane is thrown out of the slot under the effect of a centrifugal force and an end of the vane closely sticks to the inner surface of the stationary cylinder block. The vane compressor has the defects that the relative movement speed between the vane and the cylinder block is high and the mechanical friction is severe, which causes great abrasion and energy loss, and thus the service life and efficiency of the compressor are low. Although the scroll compressor and the screw compressor overcome the defects of the reciprocating compressor, the stationary disk of the scroll compressor stays still, a high relative speed exists between the stationary disk and the rotating disk, and the process is complicated and a high fabricating precision is required. The cylinder block of the screw compressor is also stationary, the rotor moves in the cylinder block, and a high relative speed exists therebetween, which results in large friction and abrasion and more importantly a high fabricating precision and a complicated process. The above compressors have a common problem that the friction and abrasion are severe, the energy loss and leakage are great, and the efficiency is low, or the fabricating process is complicated and the fabricating precision is high. The main factor is that a large relative movement always exists between one stationary part and one moving part, so it is an inevitable consequence that the friction and abrasion are large and the leakage is severe. Furthermore, since the moving inertia force is hard to be balanced, the reciprocating compressor has the defects of high vibration, short service life of the wearing parts, and poor reliability. The scroll compressor and the screw compressor have a high cost due to the high fabricating precision and complicated process.

PCT International Patent Application No. WO 2005/052373 discloses a rotary compressor, including a casing, a shaft bushing rotating freely, and a rotor. The casing has several inlets and outlets. The shaft bushing has several longitudinal openings and is disposed in the casing. The rotor has four sliding shutters and is eccentrically pressed on an inner circumference surface of the shaft bushing. A bearing inside the casing supports the rotor, and the inlets of the casing are intersected with a rotating direction of the shaft bushing. The working process of the rotary compressor is that: the above four sliding shutters are pressed on the inner circumference surface of the shaft bushing due to the centrifugal force under the forced rotation of the rotor, and in this manner, the rotor drives the shaft bushing to rotate through the sliding shutters.

SUMMARY OF THE INVENTION

The present invention is directed to a synchronous rotary compressor having a rotor and a cylinder block which respectively rotate around the rotating centers thereof and a single sliding plate which separates the cavity between the rotor and the cylinder block into two independent working chambers.

The rotary compressor of the present invention includes a casing, a cylinder block, a rotor, a main shaft, a sliding plate, a discharge valve, an eccentric mount, a support bearing, and a bracket bearing. A suction port and a discharge port are provided on the casing. A rotating center axis of the cylinder block deflects from a rotating center axis of the rotor, so that an outer circumference surface of the rotor is inscribed with an inner circumference surface of the cylinder block. A head portion of the sliding plate is embedded in a cylindrical body of the cylinder block, and a main body of the sliding plate extends into a sliding plate slot of the rotor. The discharge valve is provided on the outer circumference of the rotor in front of a rotating direction of the sliding plate. A cylinder block inlet is provided on the cylinder block in rear of the rotating direction of the sliding plate. The sliding plate and the inscribed point separate a crescent working volume between the inner circumference surface of the cylinder block and the outer circumference surface of the rotor into a suction chamber and a discharge chamber. The eccentric mount and the casing are fastened as a whole by bolts. The main shaft is cantilevered to be supported on the eccentric mount by the support bearing, and one end of an inner side of the main shaft is connected to a central shaft hole of the rotor through key and keyseat fit. An axial end at one side of the cylinder block is supported on the casing by the bracket bearing, and an axial end at the other side of the cylinder block is supported on the eccentric mount by the bracket bearing.

A discharge passage of the rotor and the central shaft hole of the cylinder block are communicated, and then are normally communicated with the discharge port of the casing. The suction port of the casing, the cavity between the casing and the cylinder block, the cylinder block inlet, and the suction chamber are normally communicated.

When the rotation angle of the main shaft is $\beta=0°$, the suction starts and the discharge ends. When the rotation angle of the main shaft is $0°<\beta$, the process of air compression starts and meanwhile the rotating suction port sucks air continuously. When the rotation angle of the main shaft is $\beta=180°$, the working volumes of the suction chamber and the discharge chamber in the working chamber are equal. When the rotation angle of the main shaft is $0°<\beta<360°$, the working chamber is in a process of continuous compression, and when β=ψ, the discharge starts. The ψ is defined as a discharge angle herein, and at this time, the pressure in the discharge chamber is greater than the external working pressure, so that the discharge valve automatically turns on and the discharge starts. The compressed air is exhausted from the discharge chamber through the discharge valve, the discharge passage, and the discharge port. When the compressed air in the discharge chamber is completely exhausted, the discharge valve automatically shuts down. When the rotation angle of the main shaft is β=360°, i.e., the main shaft rotates a cycle, the rotary compressor of the present invention completes a working cycle and then the suction chamber is filled up with air.

According to the rotary compressor of the present invention, the air suction, compression, and discharge of one working volume are completed in two cycles of the rotor. However, since the suction and compression processes are alternately carried out in the working chambers on two sides of the sliding plate, as for the entire compressor, one working cycle is completed in one rotating cycle, i.e., one process of suction and discharge is completed when the rotor rotates one cycle. In this manner, the machine runs stably, and the flow rate of air at the suction and discharge ports is low, and the flow loss is greatly reduced. The flow loss is about a half of that of the reciprocating compressor. The rotating suction port of the compressor having this structure directly sucks air and no suction valve is needed, so the suction heating phenomenon will not occur and the volume efficiency is high. In addition, the number of parts of the rotary compressor of the present invention is small and no wearing parts are used. The overall volume of the rotary compressor is reduced by 50% to 60% and the weight thereof is reduced by about 60% as compared with the reciprocating compressor, and its indicated efficiency is improved by 30% to 40% as compared with the piston compressor.

The rotor and the cylinder block of the rotary compressor of the present invention are formed by two columns, and the relative movement speed between the two is extremely low, so the friction and abrasion are greatly reduced and meanwhile the leakage of working media can be easily avoided. Since the sliding plate has a small weight and moves for a short distance, the only reciprocating inertia force on the sliding plate is very small and can be ignored. Further, the unbalance of the rotating inertia force resulting from the discontinuity of material can be easily solved by the structure. The rotating cylinder block and rotor respectively rotate around the centers thereof, and do not cause any unbalanced force, so that the machine runs stably with low vibration and low noises. In addition, since the geometrical shape of the surfaces of the main parts is column, the fabricating precision can be easily guaranteed, which facilitates the use of high-efficiency machine tools and the organization of assembly line for manufacturing, and is easy to be assembled or checked and repaired. Particularly, no eccentric moving crank shaft is used, which greatly improves the throughput of production and reduces the cost.

The rotary compressor of the present invention has another feature that one working volume may be used as the suction chamber and the discharge chamber at the same time, and the suction chamber and the discharge chamber continuously work alternately, which reduces the number of parts of the machine to form a compact structure, increases the reliability of the compressor, and meanwhile reduces the energy loss caused by the impulse of air flow.

BRIEF DESCRIPTION OF THE DRAWINGS

The present invention will become more fully understood from the detailed description given herein below for illustration only, and thus are not limitative of the present invention, and wherein:

FIGS. 9A and 9B are schematic views of an embodiment of a sliding plate in the rotary compressor according to the present invention, in which FIG. 9A is a schematic view of an end surface of the sliding plate in the rotary compressor according to the present invention, and FIG. 9B is a front view of the sliding plate in the rotary compressor according to the present invention;

FIGS. 10A and 10B are schematic views of another embodiment of the sliding plate in the rotary compressor according to the present invention, in which FIG. 10A is a schematic view of an end surface of the sliding plate in the rotary compressor according to the present invention, and FIG. 10B is a front view of the sliding plate in the rotary compressor according to the present invention; and FIGS. 11A and 11B are schematic views of a sealing structure of end surfaces of a rotor and a cylinder block in the rotary compressor according to the present invention, in which FIG. 11A is a schematic partial cross-sectional view of the end surfaces of the rotor and the cylinder block in the rotary compressor according to the present invention, and FIG. 11B is a schematic view of the end surfaces of the rotor and the cylinder block in the rotary compressor according to the present invention.

DETAILED DESCRIPTION OF THE INVENTION

Hereinafter, the embodiments of the rotary compressor of the present invention are illustrated in detail with the accompanying drawings.

Figure 1:
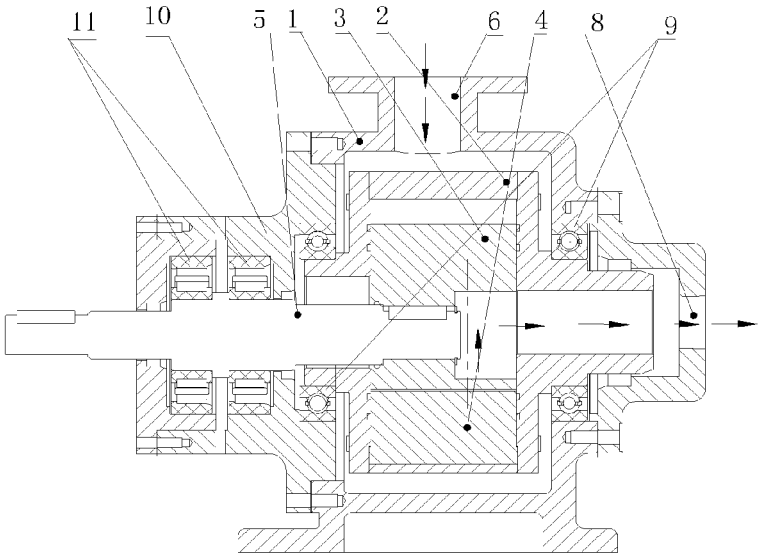
FIG. 1 is a front view of a rotary compressor according to a first embodiment of the present invention.
Figure 2:
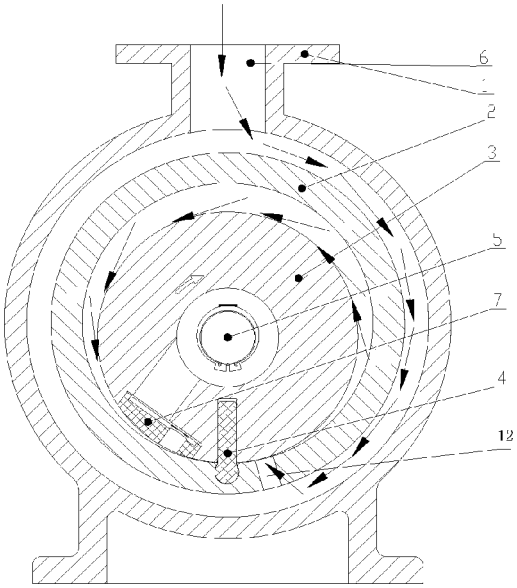
FIG. 2 is a schematic cross-sectional view of the first embodiment when a rotation angle of a main shaft is β=0°.
Figure 3:
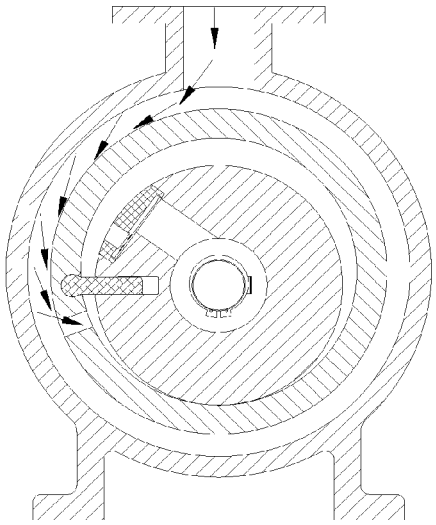
FIG. 3 is a schematic cross-sectional view of the first embodiment when the rotation angle of the main shaft is 0°<β.
Figure 4:
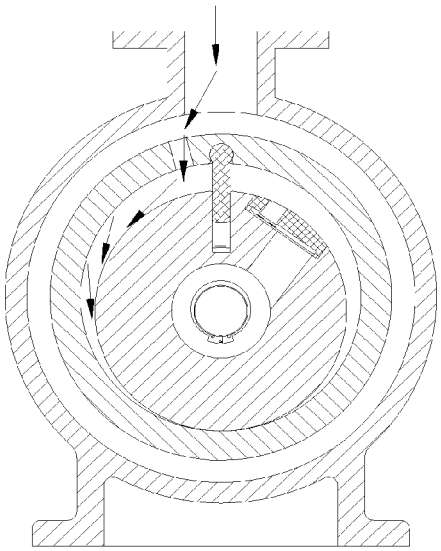
FIG. 4 is a schematic cross-sectional view of the first embodiment when the rotation angle of the main shaft is β=180°.
Figure 5:
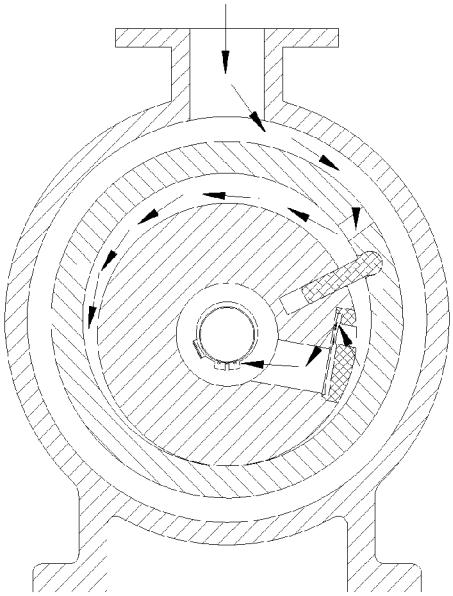
FIG. 5 is a schematic cross-sectional view of the first embodiment when the rotation angle of the main shaft is ψ<β and the discharge starts.

FIGS. 1 to 5 illustrate a rotary compressor according to a first embodiment of the present invention, in which FIG. 1 is a front view of the rotary compressor according to the first embodiment of the present invention, FIG. 2 is a schematic cross-sectional view of the first embodiment when a rotation angle of a main shaft is β=0°, FIG. 3 is a schematic cross-sectional view of the first embodiment when the rotation angle of the main shaft is 0°<β<180°, FIG. 4 is a schematic cross-sectional view of the first embodiment when the rotation angle of the main shaft is β=180°, and FIG. 5 is a schematic cross-sectional view of the first embodiment when the rotation angle of the main shaft is ψ<β.

As shown in FIGS. 1 and 2, the rotary compressor according to the first embodiment of the present invention includes a casing 1, a cylinder block 2, a rotor 3, a sliding plate 4, a main shaft 5, a suction port 6, a discharge valve 7, a discharge port 8, a bracket bearing 9, an eccentric mount 10, a support bearing 11, and a cylinder block inlet 12.

The eccentric mount 10 and the casing 1 are fastened as a whole by bolts. The main shaft 5 is cantilevered to be supported on the eccentric mount 10 by the support bearing 11, and one end of an inner side of the main shaft 5 is connected to a central shaft hole of the rotor 3 through key and keyseat fit, i.e., the rotor 3 rotates around a center axis of the main shaft 5.

The cylinder block 2 and the casing 1 are both in a column shape, an axial end on one side of the cylinder block 2 is supported on the casing 1 by the bracket bearing 9, and an axial end on the other side of the cylinder block 2 is supported on the eccentric mount 10 by the bracket bearing 9. A center axis of the cylinder block 2 is coincided with a center axis of the casing 1, i.e., the cylinder block 2 and the casing 1 are concentrically disposed, but, through the eccentric mount 10, the center axis of the cylinder block 2 deflects from the center axis of the main shaft 5. The center axis of the main shaft 5 is located below the center axis of the cylinder block 2, and the center axes of the two deflect so that an outer circumference surface at the bottom of the rotor 3 is inscribed with an inner circumference surface at the bottom of the cylinder block 2.

Since the cylinder block 2 and the rotor 3 respectively rotate around the rotating centers thereof, the cylinder block 2 and the rotor 3 do not cause any unbalanced inertia force and run stably.

Figure 9A:
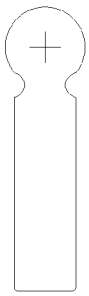
Figure 9B:
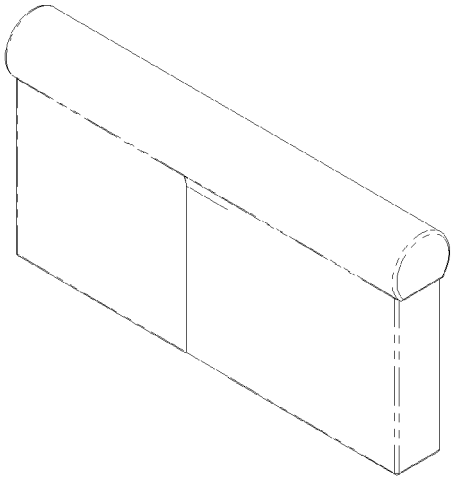

As shown in FIGS. 9A and 9B, a head portion of the sliding plate 4 of the rotary compressor of the present invention is in a column shape, and a main body thereof is in a plate shape. The head portion of the sliding plate 4 is embedded in a cylindrical body of the cylinder block 2, and the main body of the sliding plate 4 extends into a radial sliding plate slot of the rotor 3. Two ends of the column-shaped head portion of the sliding plate 4 slightly extend outside the main body of the sliding plate 4, and two ends of the column-shaped head portion of the sliding plate 4 respectively extend into two axial ends of the cylinder block 2 to form two trunnion shafts fixed in a radial direction when the sliding plate 4 swings, so as to prevent the sliding plate 4 from sliding out of the cylindrical body of the cylinder block 2. A length of the main body of the sliding plate 4 is equal to an internal axial width of the cylinder block 2, such that a liquid does not easily pass through slits on the edges of the main body of the sliding plate 4. Meanwhile, the sliding plate 4 is ensured to swing side to side along a radial direction of the rotor 3, and is adapted to the phase difference between the cylinder block 2 and the rotor 3.

When the main shaft 5 is driven by a motor to rotate, the rotor 3 rotates around the main shaft 5 and propels the cylinder block 2 to rotate through the sliding plate 4, and the cylinder block 2 rotates around the center axis of its own. When the rotation angle of the main shaft is $0°<\beta<180°$, the rotating phase of the cylinder block 2 exceeds the rotation angle of the rotor 3; while when the rotation angle of the main shaft is $180°<\beta<360°$, the rotating phase of the cylinder block 2 lags behind the rotation angle of the rotor 3, and thus the sliding plate 4 needs to swing side to side to be adapted to the phase difference between the cylinder block 2 and the rotor 3. Meanwhile, the power is transferred from the rotor 3 to the cylinder block 2, and the phase difference of the two is ensured to be zero when the rotation angle $\beta$ of the main shaft is 0°, 180°, and 360°. Therefore, the cylinder block 2 and the rotor 3 are driven to co-rotate, and it takes completely the same time for the cylinder block 2 and the rotor 3 to rotate one cycle, so the present invention is also referred to as synchronous rotary compressor.

When rotating, the inner circumference surface of the cylinder block 2 and the outer circumference surface of the rotor 3 are always inscribed at the lowest point in a vertical direction. The sliding plate 4 and the inscribed point separate a crescent working volume between the inner circumference surface of the cylinder block 2 and the outer circumference surface of the rotor 3 into two different air chambers, namely, a suction chamber and a discharge chamber, which together constitute a working chamber of the compressor. However, as a radius of rotation of the rotor 3 is different from that of the cylinder block 2, and the rotating centers thereof are also different, when rotating, the contact surfaces of the two slide relative to each other slowly, and their relative speed is rather low, which greatly reduces the friction and abrasion therebetween.

The casing 1 is a separation structure and is fastened as a whole by bolts. The suction port 6 is provided on a top end of the casing 1, and the discharge port 8 is provided on a shaft end. The cylinder block inlet 12 is provided on the cylinder block 2 in rear of the rotating direction of the sliding plate 4. Meanwhile, the central shaft hole of the cylinder block 2 constitutes a part of the discharge passage. A radial discharge passage and a discharge passage of the central shaft hole are formed on the rotor 3, and the radial discharge passage is communicated with the discharge passage of the central shaft hole. The discharge valve 7 is provided at the radial discharge passage inlet of the rotor 3, i.e., on the outer circumference of the rotor 3. The discharge valve 7 is disposed in front of the rotating direction of the sliding plate 4, and fits the outer circumference of the rotor 3, which greatly reduces the influence of the clearance volume and improves the utilization rate of the cylinder block.

In the operation of the rotary compressor of the present invention, a liquid enters the cavity between the casing 1 and the cylinder block 2 through the suction port 6 on the top end of the casing 1, and then enters the suction chamber between the cylinder block 2 and the rotor 3 through the cylinder block inlet 12, in which the suction direction is indicated by arrows as shown in FIGS. 1 to 5. As shown in FIG. 3, with the increase of the rotation angle $\beta$ of the main shaft 5, the volume of the suction chamber between the cylinder block 2 and the rotor 3 increases accordingly, and the amount of the intake air also increases continuously. When the main shaft rotates by 180°, as shown in FIG. 4, the working media that enters the suction chamber takes up a half of the working volume constituted by the cylinder block 2 and the rotor 3. Since, during the rotation of the rotary compressor of the present invention, the cylinder block inlet 12 is always communicated with the suction port 6, and no suction valve is provided therebetween, air is ensured to successfully enter the suction chamber between the cylinder block 2 and the rotor 3 through the cylinder block inlet 12 at any rotation angle of the main shaft. Meanwhile, as shown in FIG. 5, the air flow direction after compression is indicated. When the pressure in the discharge chamber is greater than the external working pressure, the discharge valve 7 automatically turns on, and the compressed air passes through the discharge valve 7, enters the discharge passage of the central shaft hole of the rotor and the discharge passage of the central shaft hole of the cylinder block 2 as shown in FIG. 1 through the radial discharge passage of the rotor 3, and finally is exhausted through the discharge port 8 as shown in FIG. 1.

During the rotation of the rotary compressor of the present invention, the discharge passage is always communicated with the discharge port 8, a continuously discharge process is thus completed, and meanwhile insecure factors caused by liquid strike are avoided.

As shown in FIG. 2, when the rotation angle of the main shaft is $\beta=0°$, the suction starts and the discharge ends. When the rotation angle of the main shaft is $0°<\beta$, as shown in FIG. 3, the process of air compression starts, and meanwhile the rotating inlet sucks air continuously. As shown in FIG. 4, when the rotation angle of the main shaft is $\beta=180°$, the working volumes of the suction chamber and the discharge chamber in the working chamber are equal. As shown in FIG. 5, when the rotation angle of the main shaft is $\psi<\beta<360°$ and $\beta=\psi$, the discharge starts. The $\psi$ is defined as a discharge angle herein, and at this time, the pressure in the discharge chamber is greater than the external working pressure, the discharge valve 7 automatically turns on, and the discharge starts. The compressed air is exhausted from the discharge chamber through the discharge valve 7, the discharge passage, and the discharge port 8. Along with the increase of the rotation angle of the main shaft, the compressed air in the discharge chamber is completely exhausted from the discharge chamber, and then the discharge valve 7 automatically shuts down. When the rotation angle of the main shaft is $\beta=360°$, i.e., the main shaft rotates a cycle, as shown in FIG. 2, the rotary compressor of the present invention completes a working cycle and then the suction chamber is filled up with air.

The above discharge valve 7 may adopt the mechanism like a cantilever reed valve or a ring valve. When the pressure in the discharge chamber is greater than the external working pressure, the air flow flushes the cantilever valve to open and enters the discharge passage through the discharge chamber. After the discharge ends, i.e., the pressure in the discharge chamber is smaller than the external working pressure, the cantilever valve returns to the original position and automatically shuts down the discharge passage.

According to the rotary compressor of the first embodiment of the present invention, the air suction, compression, and discharge of one working volume are completed in two cycles of the rotor 3. However, since the suction and compression processes are alternately carried out in the working chambers on two sides of the sliding plate 4, as for the entire compressor, one working cycle is completed in one rotating cycle, i.e., one process of suction and discharge is completed when the rotor 3 rotates one cycle. In this manner, the machine runs stably, and the flow rate of air at the suction and discharge ports is low, and the flow loss is greatly reduced. The flow loss is about a half of that of the reciprocating compressor. The rotating suction port of the compressor having this structure directly sucks air and no suction valve is needed, so the suction heating phenomenon will not occur, the volume efficiency is high, and the power loss is low. In addition, the number of parts of the rotary compressor of the present invention is small and no wearing parts are used. The overall volume of the rotary compressor is reduced by 50% to 60% and the weight thereof is reduced by about 60% as compared with the reciprocating compressor, and its indicated efficiency is improved by 30% to 40% as compared with the piston compressor.

The rotor 3 and the cylinder block 2 of the rotary compressor of the present invention are formed by two columns, and the relative movement speed between the two is extremely low, so the friction and abrasion are greatly reduced and meanwhile the leakage of working media can be easily avoided. Since the sliding plate 4 has a small weight and moves for a short distance, the reciprocating inertia force on the sliding plate 4 is very small and can be ignored. Further, the unbalance of the rotating inertia force resulting from the discontinuity of material can be easily solved by the structure.

The rotating cylinder block 2 and the rotor 3 respectively rotate around the centers thereof, and do not cause any unbalanced force, so that the machine runs stably with low vibration and low noises. In addition, since the geometrical shape of the surfaces of the main parts is column, the fabricating precision can be easily guaranteed, which facilitates the use of high-efficiency machine tools and the organization of assembly line for manufacturing, and is easy to be assembled or checked and repaired. Particularly, no eccentric moving crank shaft is used, which greatly improves the throughput of production and reduces the cost.

The rotary compressor of the present invention has another feature that one working volume may be used as the suction chamber and the discharge chamber at the same time, and the suction chamber and the discharge chamber continuously work alternately, which reduces the number of parts of the machine to form a compact structure, increases the reliability of the compressor, and meanwhile reduces the energy loss caused by the impulse of air flow.

Figure 6:
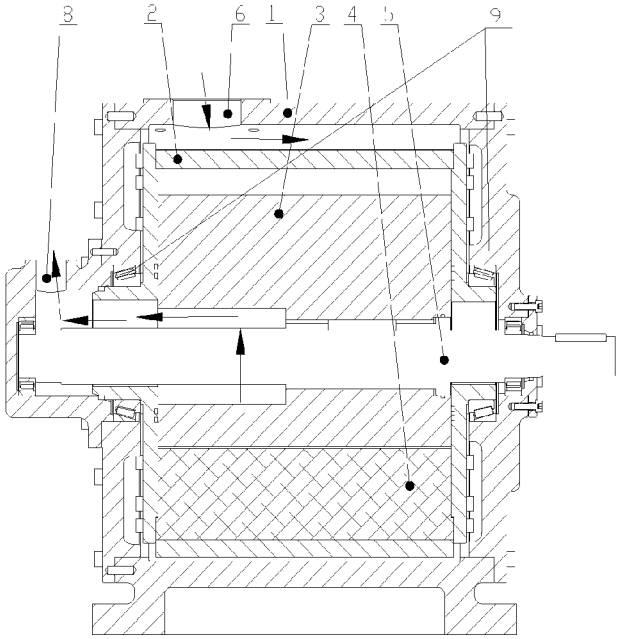
FIG. 6 is a front view of a rotary compressor according to a second embodiment of the present invention.

FIG. 6 illustrates a rotary compressor according to a second embodiment of the present invention. The rotary compressor of the second embodiment includes a casing 1, a cylinder block 2, a rotor 3, a sliding plate 4, a main shaft 5, a suction port 6, a discharge port 8, and a bracket bearing 9. The casing 1 is a separation structure and is fastened as a whole by bolts. The suction port 6 is provided at a side on a top end of the casing 1, and the discharge port 8 is provided on an outer circumference of a shaft end of the casing 1. The main shaft 5 is supported on two shaft ends of the casing 1 by a double support bearing, which greatly reduces the bending moment of the rotor 3 relative to the main shaft 5 and improves the loading state of the main shaft so as to be adapted to a large-scale rotary compressor. Since the main shaft 5 penetrates the entire central shaft hole of the rotor 3, the central shaft hole of the rotor 3 is designed into a step shape. The main shaft 5 is connected to the central shaft hole having a small diameter of the rotor 3 through key and keyseat fit, i.e., the rotor 3 rotates around the center axis of the main shaft 5. A clearance between the step-shaped large shaft hole of the rotor 3 and the main shaft 5 constitutes a discharge passage. Other parts of the structure are the same as those of the rotary compressor according to the first embodiment of the present invention, and, for the simple purpose, the details thereof will not be described herein.

Figure 7:
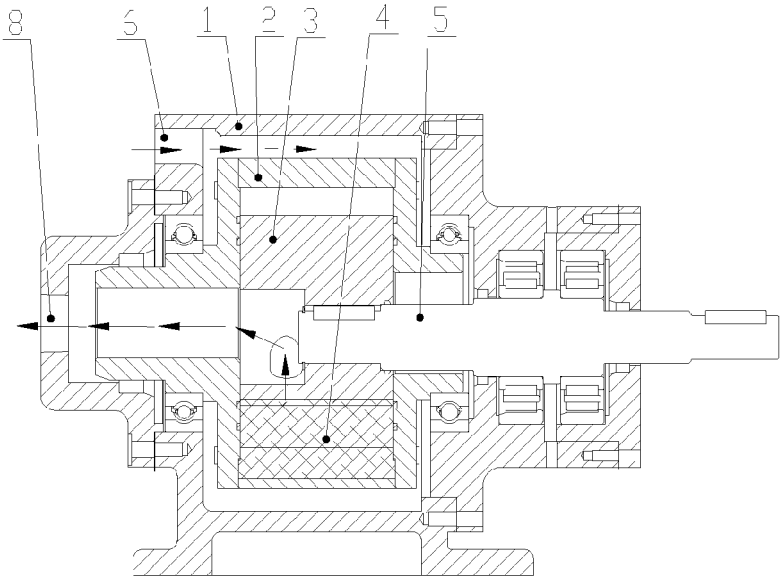
FIG. 7 is a front view of a rotary compressor according to a third embodiment of the present invention.

FIG. 7 illustrates a rotary compressor according to a third embodiment of the present invention. The rotary compressor of the third embodiment includes a casing 1, a cylinder block 2, a rotor 3, a sliding plate 4, a main shaft 5, a suction port 6, and a discharge port 8. The difference from the rotary compressor according to the first embodiment of the present invention lies in that in the rotary compressor according to the third embodiment of the present invention, the suction port 6 is provided on an end of the casing 1, i.e., disposed at an axial position, such that the rotary compressor can be used in different situations.

Figure 8:
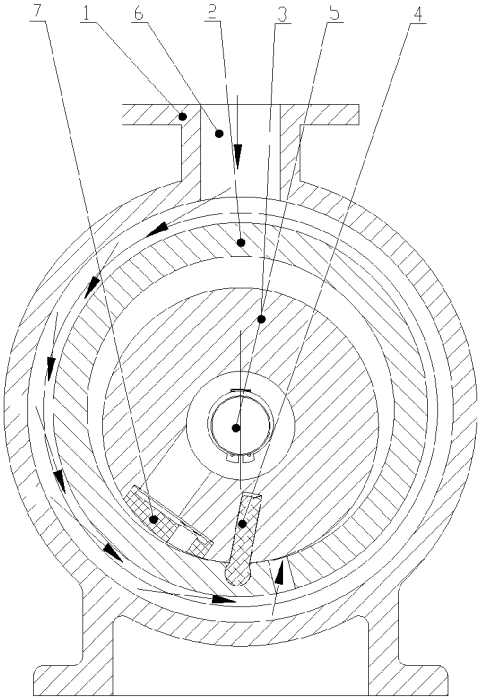
FIG. 8 is a schematic cross-sectional view of a rotary compressor according to a fourth embodiment of the present invention.

FIG. 8 illustrates a rotary compressor according to a fourth embodiment of the present invention. The rotary compressor of the fourth embodiment includes a casing 1, a cylinder block 2, a rotor 3, a sliding plate 4, a main shaft 5, a suction port 6, and a discharge valve 7. The difference from the rotary compressor according to the first embodiment of the present invention lies in that the main body of the sliding plate 4 in the rotary compressor according to the first embodiment of the present invention extends into the radial sliding plate slot of the rotor 3, while the sliding plate 4 in the rotary compressor according to the fourth embodiment of the present invention is disposed obliquely on the rotor 3, which, although somewhat increases the processing difficulty, greatly alleviates the loading state of the sliding plate 4.

Figure 10A:
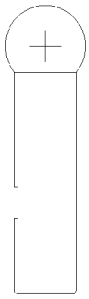
Figure 10B:
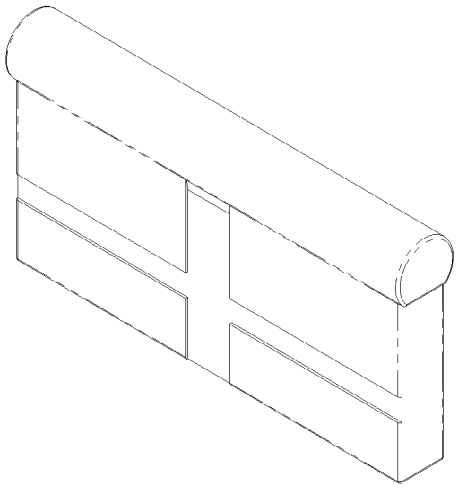

As shown in FIGS. 9A and 10A, in the rotary compressor of the present invention, a head portion of the sliding plate embedded into the cylinder block may be disposed in different structures, and thus an inner arc surface of a cylindrical body of the cylinder block 2 that accommodates the head portion of the sliding plate has a different structure. As shown in FIG. 9A, a journal is provided below the column-shaped head portion of the sliding plate, and the movement of the sliding plate embedded into the cylinder block is more flexible. As shown in FIG. 10B, no journal is provided below the column-shaped head portion of the sliding plate, and the depth of the column-shaped head portion of the sliding plate embedded into the cylinder block is shallow, which is easy to fabricate and ensures the flexible movement of the sliding plate 4.

As shown in FIG. 9B, in the rotary compressor of the present invention, a pilot slot in the moving direction of the sliding plate is disposed on a side of the sliding plate, and may also be disposed in a cross shape as shown in FIG. 10B. The pilot slot is provided to store lubricant when needed, thereby alleviating the friction and abrasion between the sliding plate 4 and the radial sliding plate slot of the rotor 3.

Figure 11A:
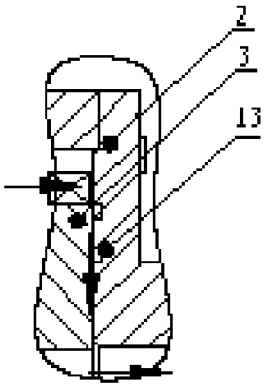
Figure 11B:
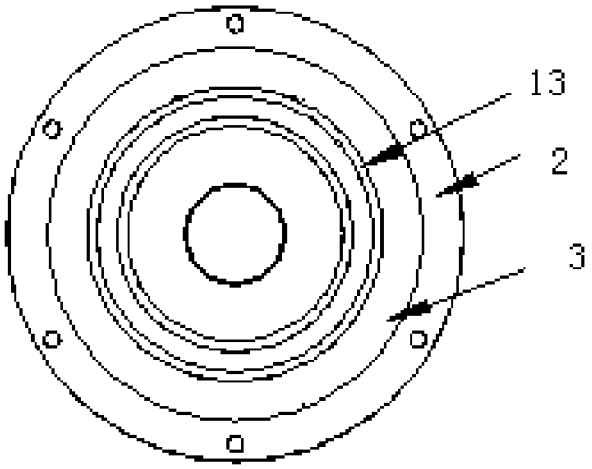

FIGS. 11A and 11B illustrate a sealing structure of end surfaces of the rotor 3 and the cylinder block 2 in the rotary compressor according to the present invention. Since a low speed relative movement exists between the cylinder block 2 and the rotor 3 in the rotary compressor of the present invention, air leakage may occur to some extent. Therefore, a sealing ring 13 is provided on the end surfaces of the cylinder block 2 and the rotor 3. As a radius of rotation of the rotor 3 is different from that of the cylinder block 2, when rotating, the contact surfaces of the two slide relative to each other slowly, and their relative speed is rather low, so that the sealing ring 13 greatly reduces the air leakage, and improves the volume efficiency of the rotary compressor.

In the rotary compressor, a major liquid leakage passage is the clearance between the inner circumference surface of the cylinder block 2 and the outer circumference surface of the rotor 3, i.e., the clearance at the inscribed point of the outer circumference surface at the bottom of the rotor 3 and the inner circumference surface at the bottom of the cylinder block 2. The size of the clearance directly influences the volume efficiency and the processing cost of the rotary compressor. As for an air compressor and a refrigeration and air-conditioning compressor, the clearance at a junction of the end surfaces of the cylinder block 2 and the rotor 3 is controlled within 2 mm. As for a rotary oil pump, the clearance between the inner circumference surface of the cylinder block 2 and the outer circumference surface of the rotor 3 is controlled within 3 mm.

However, the present invention is not limited to the above embodiments, and persons skilled in the art may make modifications, equal replacement, and parts addition, removal, or recombination according to the working principle and the embodiments of the present invention, which are regarded as new embodiments.

Although, according to the present invention, when rotating, the inner circumference surface of the cylinder block 2 and the outer circumference surface of the rotor 3 are always inscribed at the lowest point in a vertical direction, this is only an example for illustration. The inner circumference surface of the cylinder block 2 and the outer circumference surface of the rotor 3 may be inscribed at any phase on the circumference as long as the sliding plate 4 and the inscribed point separate the crescent working volume into two different air chambers, thereby forming the suction chamber and the discharge chamber.

Although, in the present invention, the suction port 6 is provided on the top end or the axial end surface of the casing 1, it should be understood that for different models, the suction port may be disposed at any possible position of the casing. As for an air rotary compressor, several suction ports may be provided, and even the casing 1 may be designed as an open frame as long as the inlet 12 of the cylinder block 2 is ensured to be communicated with the atmosphere.

Although, in the present invention, the main body of the casing 1 is column-shaped, it should be understood that for different models, the main body of the casing 1 may also be in an elliptic shape or other shapes as long as a stable support is ensured and the liquid enters the suction chamber through the cylinder block inlet 12.

Although, in the present invention, the cylinder block 2 is provided with the inlet 12, it should be understood that the number of the inlet 12 may be one, or multiple arranged in one row in an axial direction, or multiple arranged in several rows in an axial direction and a circumferential direction.

Although, in the present invention, air is taken as an example of the working media, it should be understood that the present invention may be widely applied in a variety of fields like the air compressor, the liquid transfer pump, and the refrigeration and air-conditioning compressor.

What is claimed is:

1. A rotary compressor, comprising:

a casing (1), a cylinder block (2), a rotor (3), a sliding plate (4), and a discharge valve (7), wherein a suction port (6) and a discharge port (8) are provided on the casing (1);

a main shaft (5) as a rotating center axis of the cylinder block (2) deflects from a rotating center axis of the rotor (3), so that an outer circumference surface of the rotor (3) is inscribed with an inner circumference surface of the cylinder block (2);

a head portion of the sliding plate (4) is in a column shape and a main body of the sliding plate (4) is in a plate shape, the head portion of the sliding plate (4) is embedded in a cylinder body of the cylinder block (2), two ends of the column-shaped head portion of the sliding plate (4) slightly extend outside the main body of the sliding plate (4) so as to form two trunnion shafts that are fixed in a radial direction when the sliding plate (4) swings and prevents the sliding plate (4) from sliding out of the cylinder body of the cylinder block, the main body of the sliding plate (4) extends into a radial sliding plate slot of the rotor (3);

the discharge valve (7) is provided on the outer circumference of the rotor (3) in front of a rotating direction of the sliding plate (4);

a cylinder block inlet (12) is provided on the cylinder block (2) in rear of the rotating direction of the sliding plate (4); and the sliding plate (4) and the inscribed point separate a crescent working volume between the inner circumference surface of the cylinder block (2) and the outer circumference surface of the rotor (3) into a suction chamber and a discharge chamber;

the main shaft (5) is supported on an end of the casing (1) by a double support bearing (11), two axial ends of the cylinder block (2) are supported on the casing (1) by two bracket bearings (9).

2. The rotary compressor according to claim 1, further comprising: an eccentric mount (10) wherein the eccentric mount (10) and the casing (1) are fastened as a whole by bolts, the main shaft (5) is cantilevered to be supported on the eccentric mount (10) by the double support bearings (11), and one end of an inner side of the main shaft (5) is connected to a central shaft hole of the rotor (3) through key and keyseat fit.

3. The rotary compressor according to claim 2, wherein the axial end on one side of the cylinder block (2) is supported on the casing (1) by one of the two bracket bearings (9), and the axial end on the other side of the cylinder block (2) is supported on the eccentric mount (10) by the other one of the two bracket bearings (9).

4. The rotary compressor according to claim 1, wherein a radial discharge passage and a discharge passage of the central shaft hole are provided on the rotor (3), and the radial discharge passage is normally communicated with the discharge passage of the central shaft hole.

5. The rotary compressor according to claim 4, wherein the discharge passage of the rotor (3) and the central shaft hole of the cylinder block (2) are communicated, and then are normally communicated with the discharge port (8) of the casing (1).

6. The rotary compressor according to claim 4, wherein the suction port (6) of the casing (1), a cavity between the casing (1) and the cylinder block (2), the cylinder block inlet (12), and the suction chamber are normally communicated.

7. The rotary compressor according to claim 1, wherein the suction port (6) of the casing (1), a cavity between the casing (1) and the cylinder block (2), the cylinder block inlet (12), and the suction chamber are normally communicated.

8. The rotary compressor according to claim 1, wherein the discharge valve (7) is disposed fitting the outer circumference surface of the rotor (3), and when a pressure in the discharge chamber is greater than an external working pressure, the discharge valve (7) automatically turns on to completely discharge the compressed air in the discharge chamber, and then the discharge valve (7) automatically shuts down.

9. The rotary compressor according to claim 1, wherein a length of the main body of the sliding plate (4) is fit with an internal axial width of the cylinder block (2), such that a liquid does not easily pass through slits on the edges of the main body of the sliding plate (4).

10. The rotary compressor according to claim 9, wherein a journal is provided below the column-shaped head portion of the sliding plate (4).

11. The rotary compressor according to claim 10, wherein the sliding plate (4) is provided with a pilot slot for storing lubricant.

12. The rotary compressor according to claim 9, wherein the sliding plate (4) is provided with a pilot slot for storing lubricant.

13. The rotary compressor according to claim 12, wherein the pilot slot is in a cross shape.

14. The rotary compressor according to claim 1, wherein the suction port (6) is provided at a radial position of the casing (1).

15. The rotary compressor according to claim 1, wherein a clearance between the inner circumference surface of the cylinder block (2) and the outer circumference surface of the rotor (3) is controlled within 3 mm.

16. The rotary compressor according to claim 1, wherein a clearance between the inner circumference surface of the cylinder block (2) and the outer circumference surface of the rotor (3) is controlled within 2 mm.

17. The rotary compressor according to claim 1, wherein the outer circumference surface of the rotor (3) and the inner circumference surface of the cylinder block (2) are inscribed at any point on the outer circumference surface of the rotor (3) and the inner circumference surface of the cylinder block (2) on demands.

18. The rotary compressor according to claim 1, wherein the suction port (6) is provided at an axial position of the casing (1).

19. The rotary compressor according to claim 1, further comprising: a sealing ring (13), disposed on a junction of end surfaces of the cylinder block (2) and the rotor (3).

20. The rotary compressor according to claim 1, wherein the outer circumference surface of the rotor (3) and the inner circumference surface of the cylinder block (2) are inscribed at a lowest point in a vertical direction.

* * * * *